US005759063A

United States Patent [19]

Beck, Jr. et al.

[11] Patent Number: 5,759,063

[45] Date of Patent: Jun. 2, 1998

[54] WIRE GUIDE ASSEMBLY

[75] Inventors: Hoy Smith Beck, Jr., Lexington; Dana Marpoe, Kernersville, both of N.C.

[73] Assignee: The Whitaker Corporation, Wilmington, Del.

[21] Appl. No.: 640,397

[22] Filed: Apr. 30, 1996

[51] Int. Cl.[6] ..... H01R 13/58

[52] U.S. Cl. ..... 439/465; 439/906

[58] Field of Search ..... 439/473, 465, 439/456–60, 906

[56] References Cited

U.S. PATENT DOCUMENTS

| | | | |
|---|---|---|---|
| 4,108,527 | 8/1978 | Douty et al. | 339/107 |
| 4,125,312 | 11/1978 | Aimar | 339/107 |
| 4,180,304 | 12/1979 | Lerude | 339/196 M |
| 4,448,471 | 5/1984 | Berry et al. . | |
| 4,488,769 | 12/1984 | Feigl | 339/103 M |
| 4,526,435 | 7/1985 | Borne et al. | 339/103 C |
| 4,549,780 | 10/1985 | Bertini et al. | 339/107 |
| 4,575,174 | 3/1986 | Leeds et al. | 339/103 M |
| 4,606,596 | 8/1986 | Whiting et al. | 339/107 |
| 5,234,358 | 8/1993 | Polgar | 439/465 |
| 5,389,006 | 2/1995 | Noschese | 439/354 |

*Primary Examiner*—Khiem Nguyen
*Assistant Examiner*—Eugene G. Byrd
*Attorney, Agent, or Firm*—Bradley N. Ditty

[57] ABSTRACT

A wire guide assembly (10) mounted to an electrical connector (20) for orienting a bundle of wires exiting from a wire exit face of the connector (20). The wire guide assembly (10) comprises upper and lower pieces (30,40) each with respective latching structure (36,46) for connecting the pieces (30,40) together. Additionally, the upper and lower pieces (30,40) each include mounting structure (32,33;44) for mounting the assembly (10) to the connector (20). The latching structure (36,46) advantageously provides clamping forces to the mounting structure (32,33;44) for imparting structural rigidity to the assembly (10) and thereby supporting and guiding a bundle of wires.

20 Claims, 2 Drawing Sheets

WIRE GUIDE ASSEMBLY

The present invention relates to a wire guide assembly for use with an electrical connector; more particularly, the wire guide assembly of the present invention is clampingly mounted directly to the back of an electrical connector at its wire exit face and allows for a bundle of wires to exit at one, two, or three possible areas from within the wire guide assembly.

BACKGROUND OF THE INVENTION

Wire guides are typically used in the motor vehicle industry for the purposes of supporting and guiding a plurality of wires terminated to electrical connectors, for example, wires which comprise part of a motor vehicle wiring harness The supporting function is important in protecting electrical terminations in a connector housing from strain acting on the conductors. The guiding function is important in environments where exposed machinery parts are in motion, for example, in the engine compartment of a motor vehicle. Improperly guided wires may become entangled in the moving machinery or engine parts and can be broken, or the entire wiring harness can be ripped apart in seconds.

Wiring harness assemblies including wire guides should therefore be compact, and must reliably perform their functions in spite of the harsh conditions associated with use in a motor vehicle engine compartment, namely, mechanical vibration, temperature/heat cycling, and/or corrosive chemical vapors, fluids, gasses and etc. Moreover, an engine mechanic must be able to service the electrical components to which the wiring harness is interconnected, but do so with a minimum of disassembly/assembly time and effort. Finally, the wire guide should be produced and assembled at low cost.

A known wire guide assembly is disclosed in U.S. Pat. No. 5,234,358, which comprises a two-piece wire guide assembly connected to a wire exit face of an electrical connector for providing strain relief to the wires and thereby protecting the terminations within the connector housing. This known assembly requires a body half comprising four distinct latching posts which latchably engage latching projections on a top half of the assembly. The walls of the body and top halves are continuous and must be broken to form an aperture whereby the wires may exit. Overall, assembly of the body and top halves to the connector defines a bulky protuberance extending therefrom. Moreover, a large mass of plastic material is required to form the body and top halves thereby increasing the production cost of the assembly.

The present invention solves the foregoing problems by providing a wire guide and strain relief assembly which does not require any walls to be broken for wire egress, is of a very compact size, and is a low production assembly cost item

SUMMARY OF THE INVENTION

In view of the foregoing, the present invention provides an electrical connector assembly comprising an electrical connector having a wire guide receiving section located adjacent a wire exit face thereof, and a two-piece wire guide assembly comprising assembly mounting structure in clamping engagement with the electrical connector wire guide receiving section, the wire guide assembly comprises latching structure for latching sections of the wire guide assembly together, and the wire guide assembly comprises a plurality of open ports for permitting wires to exit therethrough.

The mounting structure comprises at least one clip for clampingly mounting the assembly to the electrical connector, and the clip is reinforced by a respective gusset. Additionally, the wire guide assembly comprises plates with one of the open ports therebetween, and the mounting structure comprises at least one rail spanning the plates for clampingly mounting the assembly to the electrical connector. Further, the plates comprise respective portions of the latching structure which latch with latching lugs, thereby generating the clamping forces which clamp the assembly to the electrical connector. Moreover, each of the open ports comprises a respective wire support for receiving a wire-wrap member therearound and supporting a bundle of wires.

DETAILED DESCRIPTION OF THE INVENTION

Figure 4:
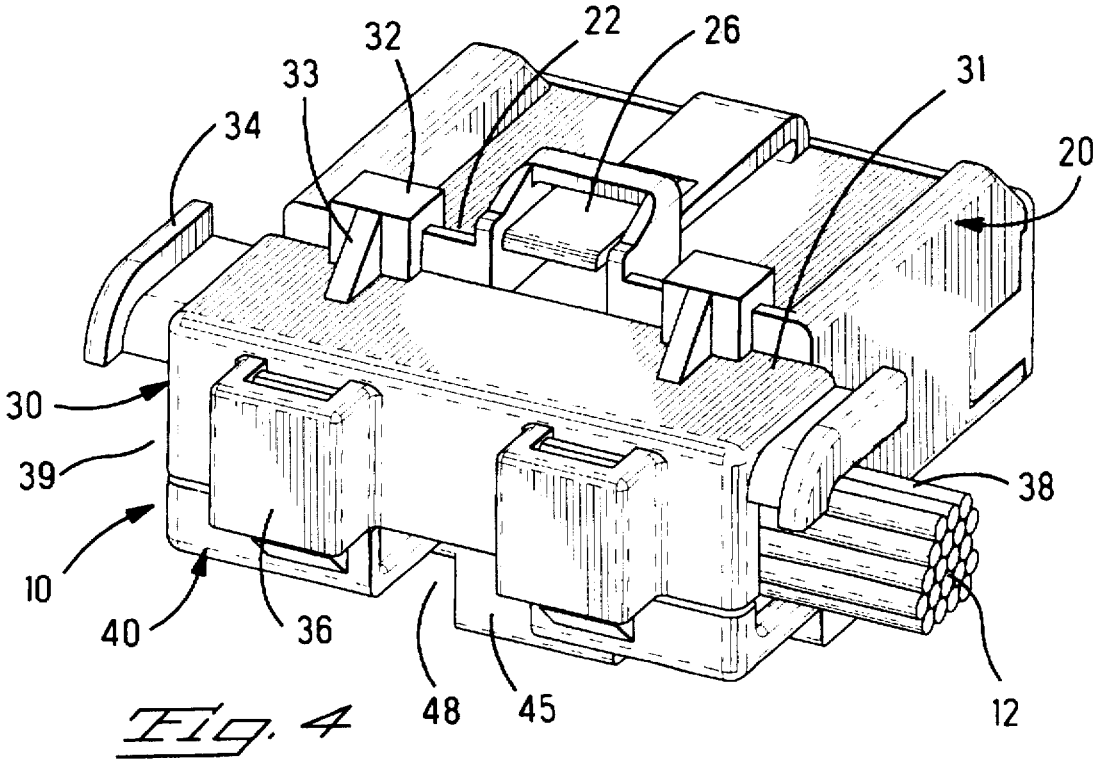
FIG. 4 shows an rear isometric view of the wire guide assembly in an assembled state.

Referring to FIGS. 1–4, a wire guide assembly 10 according to the present invention will now be described. Wire guide assembly 10 is arranged to orient a bundle of wires 12 (as shown in FIG. 4), which wires exit from an electrical connector 20 and are terminated with electrical contacts therein (not shown in the drawing).

The electrical connector 20 includes: two upper back wall sections 22; a lower back wall 24; and a resilient latch arm 26 between the upper back wall sections 22 for latchable engagement with a further connector member (not shown).

The wire guide assembly 10 is a two-piece assembly comprising an upper piece 30 and a lower piece 40. Upper piece 30 includes: a body section 31 for final disposition adjacent to latch arm 26; clips 32 for mounting engagement with upper back wall sections 22 of connector 20; a respective gusset 33 for supporting each clip 32; and a pair of laterally extending wire-wrap sections 34 for receiving a wire fastening member (not shown) when a bundle of wires extends through the wire guide assembly 10. The lateral wire-wrap sections 34 are purposely aligned with wire exit areas 38,39 for supporting respective wire bundles (see FIG. 4). Additionally, a back face of upper piece 30 comprises latch receiving, robust lugs 36 having shoulders 36*a* (see FIG. 2) for latching engagement with latches 46 of lower piece 40.

Lower piece 40 includes: plate sections 41,42 (see FIG. 1); a rail 44 for engagement with lower back wall 24 of connector 20 (see FIG. 1); a downwardly directed wire-wrap section 45 (see FIG. 2); deflectable latches 46 integral with respective plate sections 41,42 having hooks 46*a* for latching engagement with shoulders 36*a* of latch receiving lugs 36; and a wire exit area 48 between plate sections 41,42 for receiving a downwardly directed bundle of wires.

Figures 1, 2:
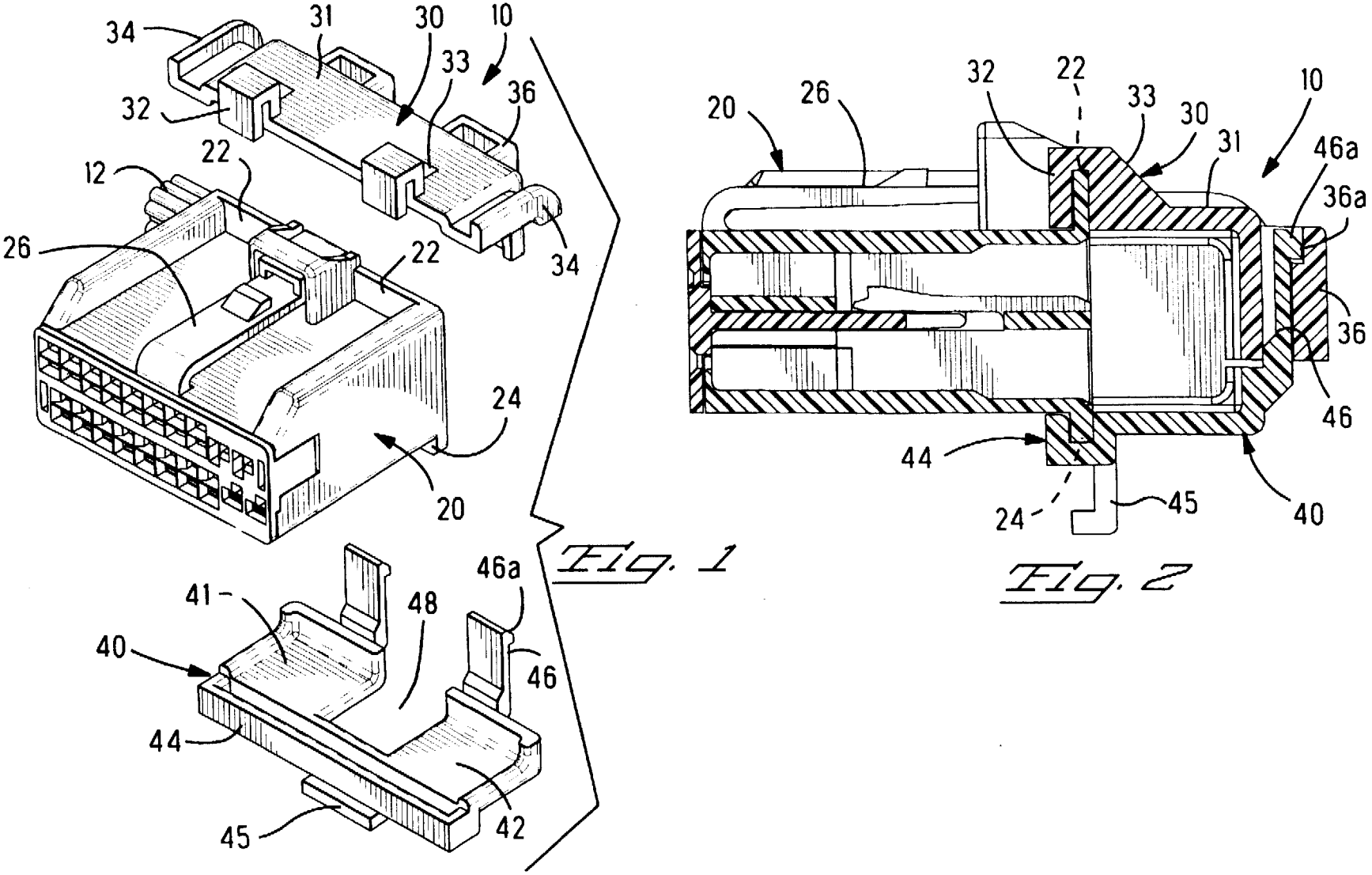
FIG. 1 shows an exploded isometric view of the wire guide assembly according to the present invention with an electrical connector for use therewith.
FIG. 2 shows a cross sectional view of the wire guide assembly and the electrical connector of FIG. 1 when in an assembled state.
Figure 3:
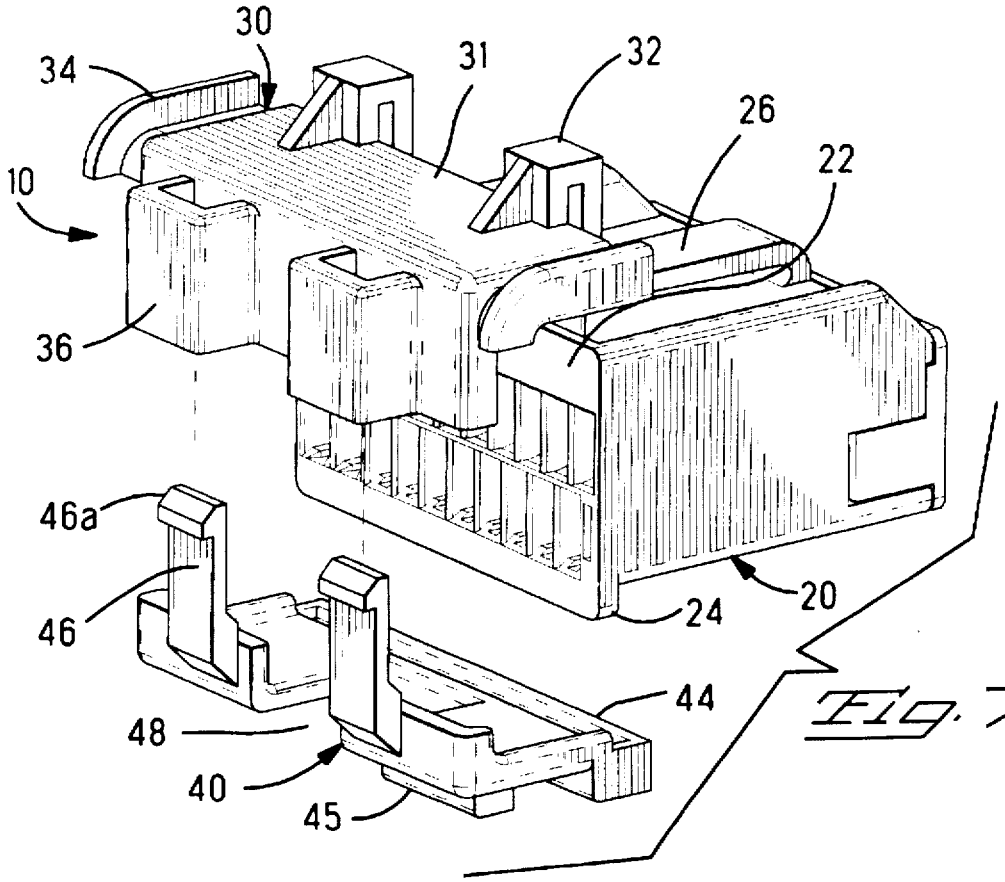
FIG. 3 shows an exploded view of the assembly of FIG. 1 connected to the electrical connector.

Assembly of the wire guide assembly 10 will now be described The upper piece 30 is first assembled to the top of connector 20 so that clips 32 preferably loosely receive back wall sections 22 therein (see FIG. 2). At this point, wires exiting connector 20 should be bundled in a particular direction with respect to wire exit areas 38, 39, or 48, for example, through wire exit area 38, as shown in FIG. 4. Next, lower piece 40 is properly aligned with upper piece 30, and is then moved toward upper piece 30 so that rail 44 preferably loosely receives lower back wall 24 therein. As this occurs, latches 46 will be latchingly disposed in latch receiving lugs 36 of upper piece 30 so that hooks 46*a* engage shoulders 36*a* and thereby latch the upper piece 30 to the lower piece 40. It is notable that clips 32, which are structurally reinforced by gussets 33, will be securely mounted to respective upper back wall sections 22, and rail 44 will be securely mounted to lower back wall 24, thereby trapping the connector 20 therebetween. The latching of latches 46 with lugs 36 advantageously draws the upper and lower pieces 30,40 together, clamping the clips 32 onto upper back wall sections 22 and rail 44 onto lower back wall section 24, which thereby defines a firm, structurally sound assembly.

A bundle of wires can be advantageously directed to exit from any of three wire exit area orientations; namely, wire exit 38, wire exit 39, and wire exit 48. Because the wire exit areas 38–40 comprise open ports in the assembly 10 for passage of the wires, the operator need not break or rearrange any portion of the assembly 10. Additionally, the assembly 10 preferably requires only latching structures 36,46, for generating sufficient clamping forces rather the than the bulky latching structure of prior wire guide assemblies. As shown in FIG. 4, the depth of the wire guide assembly 10 is approximately the same as the outer diameter of the bundle of wires 12. Latches 46 and lugs 36 are therefore also spaced from rails 44, clips 32 and the back wall sections 22 and 24 by approximately the outer diameter of the bundle of wires. This close spacing not only provides a compact assembly but also means that a structurally firm latching assembly results.

Moreover, the present invention provides a compact, structurally firm, wire guide and strain relief assembly 10. Furthermore, the open port design results in a minimum amount of plastic material being used in production of the assembly 10, thus the assembly is inexpensive to manufacture.

Thus, while a preferred embodiment of the present invention has been disclosed, it is to be understood that the invention is not to be strictly limited to such embodiment but may be otherwise variously embodied and practiced within the scope of the appended claims. For example, clips 32 can be adapted to snugly, rather than loosely, receive back wall sections 22 therein; and rail 44 can be adapted to snugly, rather than loosely, receive lower back wall 24 therein.

Accordingly, What is claimed is:

1. An electrical connector assembly comprising:

an electrical connector having a wire guide receiving section located adjacent to a wire exit face thereof; and a two-piece wire guide assembly comprising assembly mounting structure in clamping engagement with said electrical connector wire guide receiving section, said wire guide assembly comprises latching structure for latching sections of said wire guide assembly together, and said wire guide assembly comprises three ports for permitting wires to exit therethrough in three directions, each parallel to the wire exit face.

2. The electrical connector assembly of claim 1, wherein said mounting structure comprises at least one clip for mounting said assembly to said electrical connector.

3. The electrical connector assembly of claim 2, wherein said clip is reinforced by a respective gusset of said wire guide assembly.

4. The electrical connector assembly of claim 1, wherein one piece of said wire guide assembly comprises plates with one of said ports therebetween.

5. The electrical connector assembly of claim 4, wherein said mounting structure comprises at least one rail spanning said plates for mounting said assembly to said electrical connector.

6. The electrical connector assembly of claim 4, wherein said plates comprise respective portions of said latching structure.

7. The electrical connector assembly of claim 1, wherein each of said ports comprises a respective wire support section of said wire guide assembly.

8. An electrical connector assembly comprising:

an electrical connector having wire guide receiving sections located adjacent a wire exit face thereof, wires extending from said wire exit face in a wire bundle; and a wire guide assembly comprising at least one wire exit area through which the wire bundle exits and first and second halves having assembly mounting structure in engagement with said electrical connector wire guide receiving section, said halves each comprise latching structure for latching sections of said wire guide assembly together, the latching sections being spaced from the wire guide receiving sections by a distance approximately equal to the size of the wire bundle, and said latching structure is operative to provide clamping forces to said mounting structure, whereby said mounting structure is clamped to said electrical wire guide receiving sections.

9. The electrical connector assembly of claim 8, wherein said first half comprises a body section, said body section comprises at least one clip, and said clip clamps on a portion of said electrical connector wire guide receiving section.

10. The electrical connector assembly of claim 9, wherein said clip is reinforced by a gusset of said body section.

11. The electrical connector assembly of claim 8, wherein said second half comprises a rail, and said rail clamps on a portion of said electrical connector wire guide receiving section.

12. The electrical connector assembly of claim 8, wherein said electrical connector is clamped by a clip and a rail of said wire guide assembly.

13. The electrical connector assembly of claim 8, wherein said clamping forces are generated by latches engaging latching shoulders of said wire guide assembly.

14. The electrical connector assembly of claim 1 wherein two ports are formed between two wire guide members forming the two-piece wire guide assembly and a third port extends through an opening in one of the two wire guide members.

15. The electrical connector assembly of claim 14 wherein the third port comprises an open area between two plate sections in a lower wire guide member, so that wires extending through the third port extend downwardly relative to the other two ports.

16. The electrical connector assembly of claim 1 wherein wire wrap sections for receiving wire fastening members are located adjacent the exterior of each of the three ports.

17. The electrical connector assembly of claim 1 wherein the wire guide receiving section on the electrical connector comprises oppositely facing back walls on the wire exit face and the wire guide assembly includes oppositely facing female members extending beyond the remainder of the wire guide assembly, the female members fitting over the back walls so that the depth of the wire guide assembly can be reduced.

18. An electrical connector assembly for connecting a plurality of wires to a mating connector, wires exiting the connector assembly in a wire bundle close to a wire exit face, the connector assembly comprising:

an electrical connector having a mating face and a wire exit face and back walls extending in opposite directions on the wire exit face;

a wire guide assembly comprising an upper wire guide piece and a lower wire guide piece joined together with open opposite ends so that the wire bundle can alternatively exit in opposite directions through the opposite open ends;

the upper wire guide piece comprising a plate section including clips extending from a front edge and latching lugs extending downwardly from a rear edge;

the lower wire guide piece comprising two plate sections separated by a wire exit area through which a wire bundle can exit parallel to the wire exit face and perpendicular to the direction in which wires can exit through the open ends of the wire guide assembly;

latches on the lower wire guide piece extending upwardly from a rear edge of the lower wire guide piece on opposite sides of the wire exit area, the latches being engagable with the latching lugs on the upper wire guide piece; and a rail extending along the front edge of the lower wire guide piece, the rail and the clips fitting over the back walls on the electrical connector to clamp the wire guide assembly on the electrical connector so that the wire guide assembly form a compact extension of the electrical connector assembly and the wire bundles can exit is three directions each close to the wire exit face.

19. The electrical connector assembly of claim 18 wherein wire wrap sections for receiving wire fastening members are located adjacent the exterior of each of the ends thereof and adjacent the wire exit area so that the wire guide assembly also comprises a strain relief for wires for wires exiting in three directions parallel to the wire exit face.

20. The electrical connector assembly of claim 18 wherein the depth of the wire guide assembly exceed the outer diameter of the wire guide bundle only by the thickness of the plates and the thickness and lugs.

* * * * *